US005303770A

United States Patent [19]

Dierbeck

[11] Patent Number: 5,303,770

[45] Date of Patent: Apr. 19, 1994

[54] MODULAR HEAT EXCHANGER

[76] Inventor: Robert F. Dierbeck, 2707 Hall Rd., Hartford, Wis. 53027

[21] Appl. No.: 72,497

[22] Filed: Jun. 4, 1993

[51] Int. Cl.[5] ..... F28F 9/26

[52] U.S. Cl. ..... 165/140; 165/144; 165/148

[58] Field of Search ..... 165/140, 144, 148, 178, 165/130

[56] References Cited

U.S. PATENT DOCUMENTS

| | | | |
|---|---|---|---|
| 1,962,837 | 6/1934 | Raible | 165/144 X |
| 1,974,402 | 9/1934 | Templeton | 165/144 X |
| 2,002,763 | 5/1935 | Bair | 165/144 X |
| 2,013,186 | 9/1935 | Price | 165/144 X |
| 2,044,457 | 6/1936 | Young | 165/144 |
| 2,068,236 | 1/1937 | Kuenstler | 165/130 |
| 2,083,028 | 6/1937 | Livar | 165/144 X |
| 2,124,787 | 7/1938 | Lachasse | 165/144 |
| 2,343,387 | 3/1974 | Sargent et al. | 165/130 |
| 3,222,764 | 12/1965 | Hansson et al. | 29/890.05 |
| 3,396,785 | 8/1968 | Kirsch | 165/148 X |
| 3,476,178 | 11/1969 | Härting | 165/148 X |
| 3,692,105 | 9/1972 | O'Connor | 165/181 |
| 4,150,719 | 4/1979 | Thielen et al. | 165/140 |
| 4,979,560 | 12/1990 | Dierbeck | 165/76 |
| 5,042,572 | 8/1991 | Dierbeck | 165/76 |
| 5,148,863 | 9/1992 | Fouts et al. | 165/144 |

*Primary Examiner*—John Rivell

*Attorney, Agent, or Firm*—Andrus, Sceales, Starke & Sawall

[57] ABSTRACT

A modular heat exchanger includes unitary finned tubular core elements which can be assembled into a multi-module heat exchanger without any brazed, soldered or welded connections. The heat exchanger may be constructed to be fully disassemblable or, in another embodiment, larger subassemblies of modules welded together may be used to provide units which are partly disassemblable to effect easy field replacement. The modules are preferably made from extruded aluminum blocks into which the heat exchanging fins are cut and into the ends of which flow accumulating passages may be bored. The modules are clamped together with tie rods and the sealed joints are positioned to be automatically compressed into sealing engagement upon tightening the tie rods.

13 Claims, 4 Drawing Sheets

FIG. 1
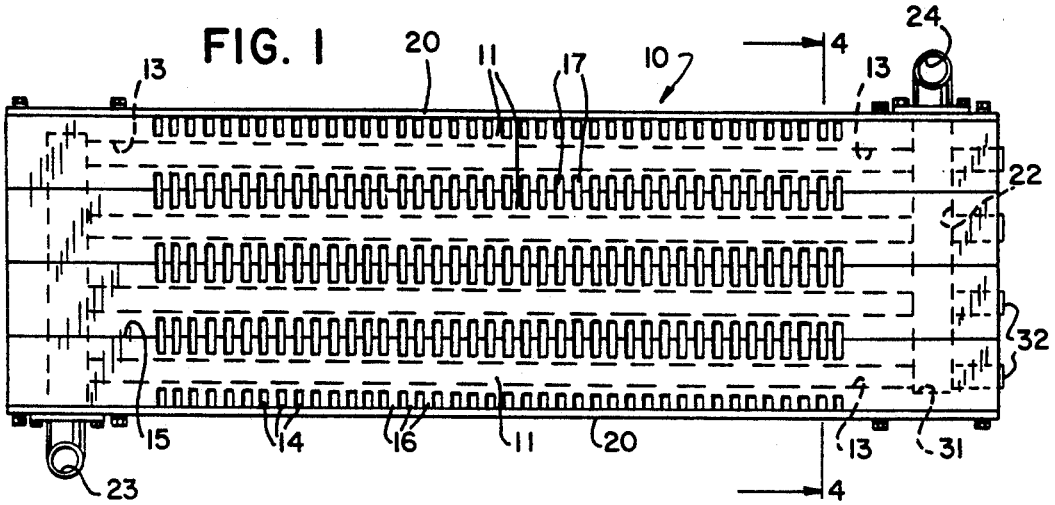
FIG. 2
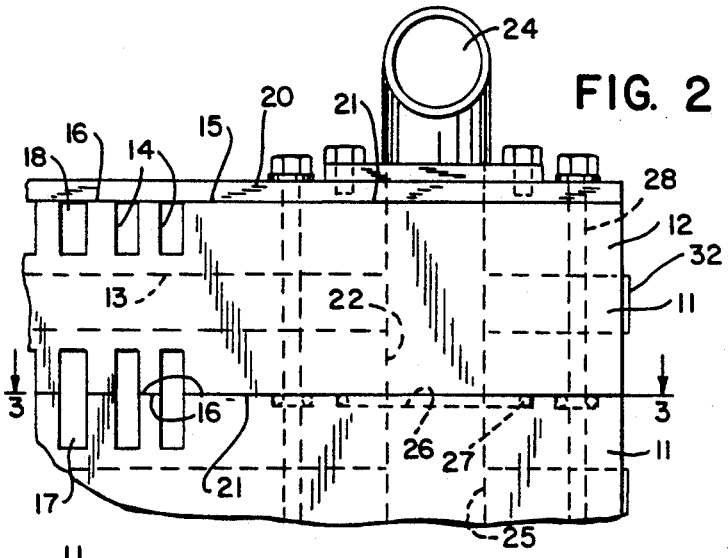
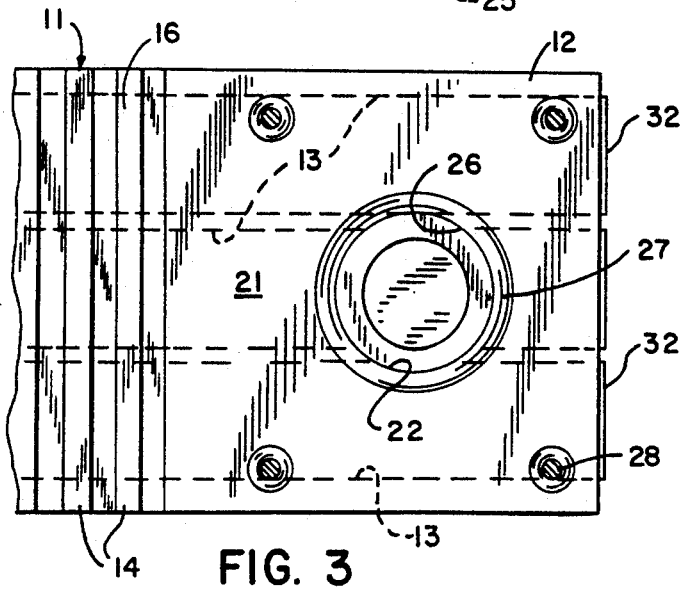
FIG. 3
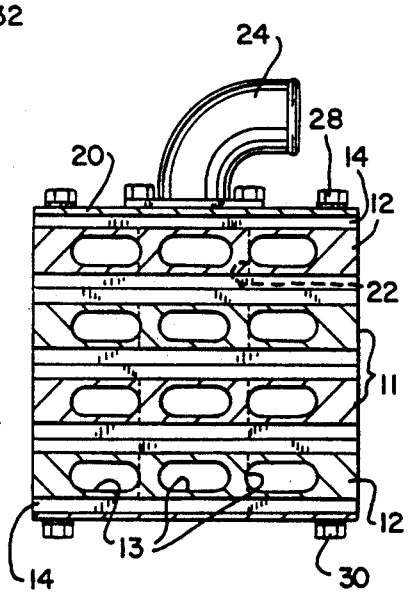
FIG. 4

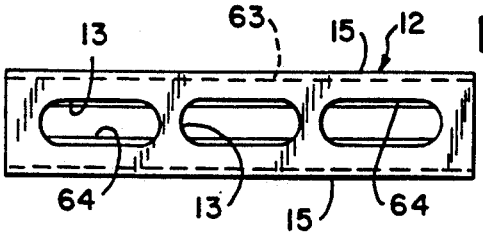
FIG. 5
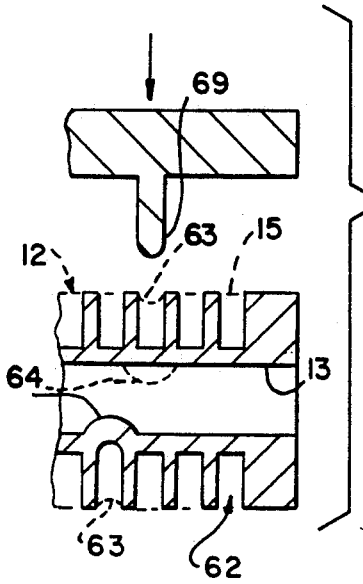
FIG. 6
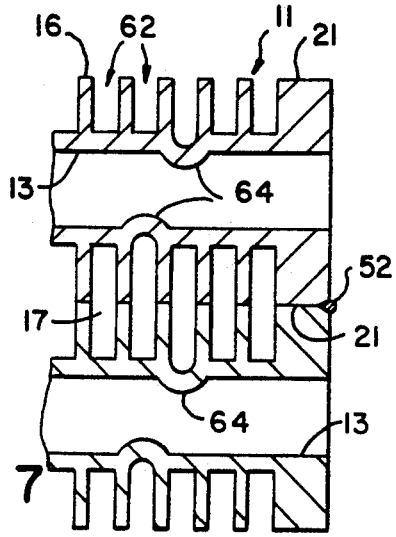
FIG. 7
FIG. 8
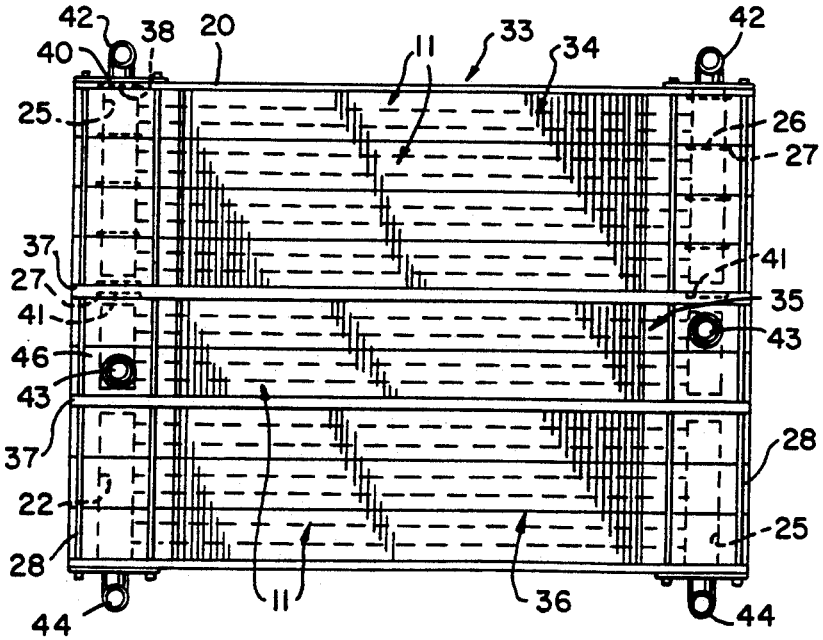
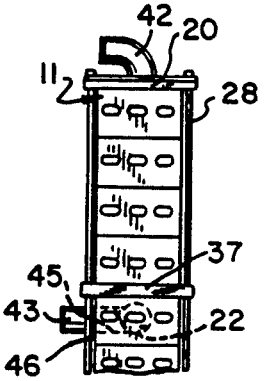
FIG. 9

FIG. 12
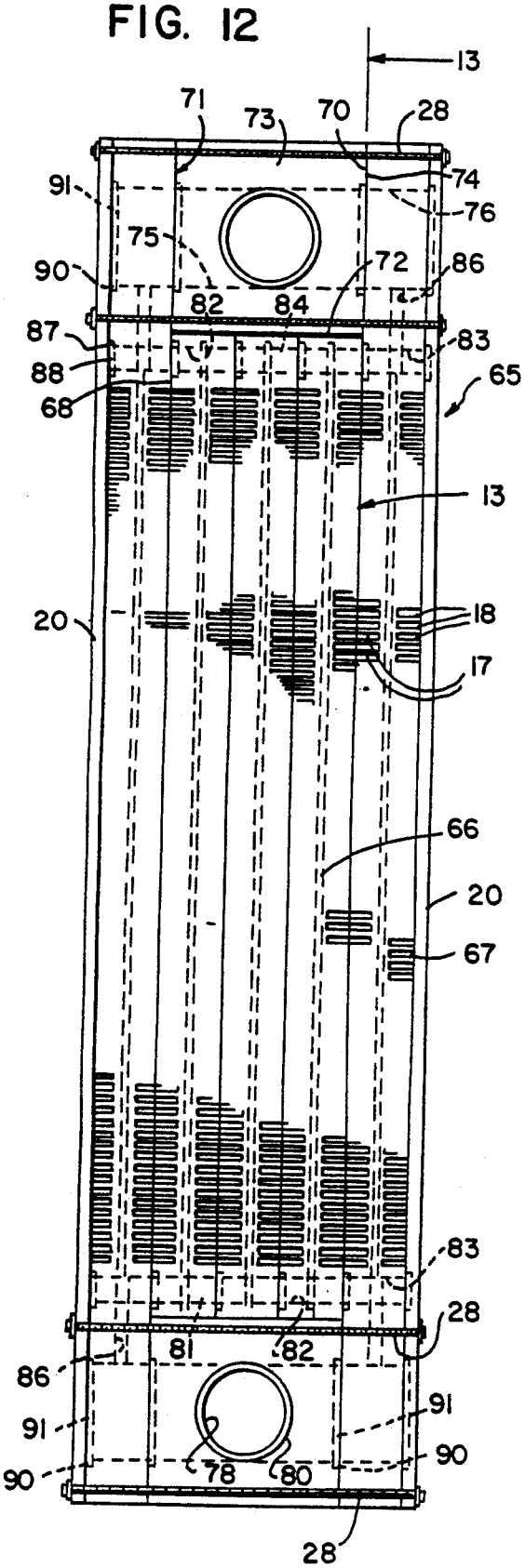
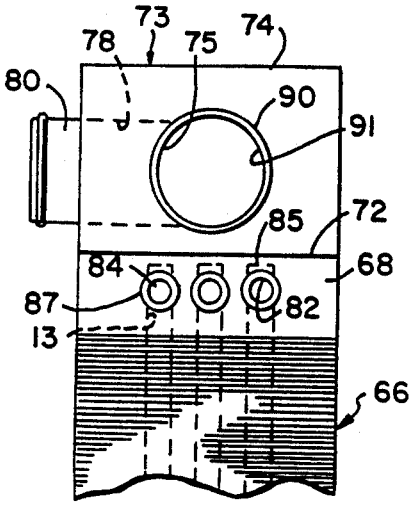
FIG. 13
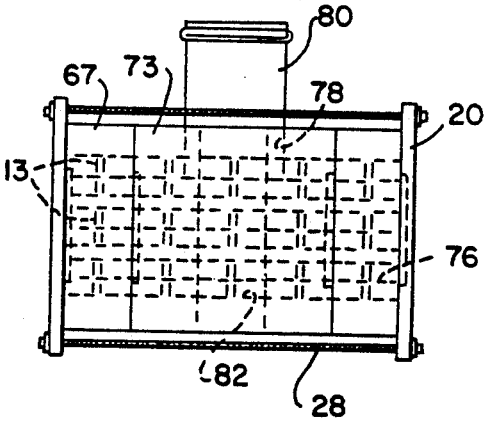
FIG. 14

MODULAR HEAT EXCHANGER

BACKGROUND OF THE INVENTION

The present invention pertains to heat exchangers for flowing fluids and, more particularly to a modular heat exchanger in which each of the core modules is formed from a unitary block of a heat exchange material.

Conventional heat exchanger construction of the type particularly adapted for automotive use utilizes heat exchanging core elements which include a series of generally parallel tubular conduits extending between and attached at their opposite ends to inlet and outlet headers. The tubular conduits are typically provided with heat conducting and dissipating fins which may be either of a flat plate or serpentine construction and which are soldered or brazed to the tubular conduits. The conduits, in turn, are also typically soldered or brazed to the headers or to similar fluid accumulating tanks. The rigid soldered or brazed joints have always constituted a common source of heat exchanger failure and, when the heat exchangers are used in automotive applications, repairs usually require removal of the entire radiator and resultant downtime for the automotive equipment. Thus, there has long been a need for a modular heat exchanger which can be repaired easily and quickly and, most preferably, without taking the equipment out of service. Furthermore, there has long been a need and desire for a heat exchanger having unitary core elements and one in which brazed or soldered connections can be minimized and, preferably, eliminated completely.

U.S. Pat. No. 3,222,764 discloses various related methods for making unitary finned tubular conduits, suitable for use in heat exchangers, from billets of aluminum or other ductile metals. An aluminum billet with a central through bore is provided with a series of cut grooves on opposite surfaces extending in the direction of the through bore. The billet is then rolled transversely and longitudinally to flatten the ridges forming the grooves and to close the bore. The reduction in thickness of the billet is extreme (to about 1/40 the original billet thickness) and the finned walls originally defining the walls of the cut slots are mechanically peeled back to form a series of parallel upstanding fins. The bore is also reopened to form a unitary finned conduit. Various alternate embodiments of finned tubes are shown, but there is no disclosure of any structure or method for incorporating the same into a modular heat exchanger.

U.S. Pat. No. 3,692,105 also describes a unitary heat exchanger core in which an elongate tubular aluminum member has a series of parallel fins formed thereon by peeling back surface layers in stepwise fashion and turning the peeled layers upwardly to extend perpendicularly from the tubular member. This patent also discloses bending a long section of such a unitary finned tube in a serpentine pattern to form a heat exchanger unit. The construction, however, is not modular.

My own U.S. Pat. Nos. 4,979,560 and 5,042,572 disclose modular heat exchangers of the type having easily replaceable modules and which are suitable for automotive or mobile equipment applications. However, the modules disclosed in these patents are of conventional tube and fin construction or of a corrugated sheet metal construction which require substantial amounts of welding, brazing or soldering to assemble the various components.

SUMMARY OF THE INVENTION

In accordance with the present invention, a modular heat exchanger includes unitary finned tubular core elements which can be assembled into a multi-module heat exchanger, including flow distributing headers or end tanks without any brazed, soldered, or welded connections of any kind. The heat exchanger is fully disassemblable in one embodiment and, in another embodiment, welded or brazed connections may be utilized to provide units which are partially disassemblable.

The modular heat exchanger of the principal embodiment of the present invention includes a plurality of modules which are formed from elongate aluminum blocks, each of which blocks has a generally rectangular cross section and a longitudinally extending through bore. Each module is formed with a series of parallel fins on opposite faces of the block, with the fins lying in planes generally perpendicular to the longitudinal axis of the through bore. The outer edges of the fins on each face lie coplanar with the face in which they are formed. Means are provided for securing the modules together in face-to-face contact with the outer edges of the fins on adjacent modules abutting one another. Fluid accumulation means are provided on opposite ends of the attached modules for interconnecting the ends of the through bores on each of said opposite ends.

The attachment means for securing the modules together is preferably demountable. In one embodiment, the attachment means comprises a plurality of tie rods for each end of the heat exchanger with the tie rods positioned to extend across the modules in a direction perpendicular to the opposite faces, and means are provided for tensioning the tie rods to clamp the modules together. Alternately, the modules may be permanently attached to one another, as by welded connections attaching each adjacent pair of modules.

In another embodiment of the demountable heat exchanger, flat face portions are provided at both ends of each of the opposite faces of the module, which face portions define the ends of each series of fins. The fluid accumulation means comprises a cross bore extending perpendicular to and passing through abutting face portions and intersecting the through bores at each end. Means are also provided for sealing the abutting face portions around the periphery of each cross bore passage through abutting face portions.

The sealing means preferably comprises a counter bore in the cross bore at one of each pair of abutting face portions, and an annular seal positioned in each counter bore. Means are also provided for closing the ends of the module through bores. In one embodiment, the attachment means comprises a face plate for the outside face portions of both outside modules, and tie rod means which extend through the face plates on both ends of the modules to clamp the modules together and compress the sealing means.

The modular heat exchanger of the present invention may be assembled in a single unit to provide an independent heat exchanger for each of a plurality of separate fluid flows. A plurality of modules are formed from elongate blocks of a heat transfer material, such as aluminum, with each block having a generally rectangular cross section and one or a plurality of parallel longitudinally extending through bores. Each module is provided with a series of parallel fins which are formed on opposite faces of the block and overly the single or plurality of through bores, with the fins disposed generally perpendicular to the axes of the through bores and the outer edges of the fins on each face lying coplanar with the face in which they are formed. Means are provided to secure the modules together to form an independent heat exchanger for each separate fluid flow. Each independent heat exchanger includes at least two modules with the modules in each heat exchanger arranged in face-to-face contact, the edges of the fins on adjacent modules in each heat exchanger abutting one another, and the separate heat exchangers arranged in spaced face-to-face position with the edges of the fins on adjacent heat exchangers abutting the opposite sides of a common separator plate. Fluid accumulation means are provided on opposite ends of all modules in the heat exchanger for interconnecting the ends of the through bores on each of said opposite ends.

The present invention also includes a method for making a modular heat exchanger which includes the steps of: forming a plurality of modules from elongate blocks of a heat exchanging material, such as aluminum, each block having a generally rectangular cross section and a longitudinally extending through bore; forming a series of parallel fins on opposite faces of the block, with the fins lying in planes generally perpendicular to the longitudinal axis of the through bore, and the outer edges of the fins on each face lying coplanar with the face in which the fins are formed; securing the modules together in face-to-face contact with the outer edges of the fins on adjacent modules abutting one another; and, interconnecting the open ends of the through bores on both ends of the attached modules to accumulate the fluid flow at each end of the heat exchanger.

The method preferably includes the step of deforming the opposite faces of the blocks, prior to forming the fins, to form a series of spaced parallel grooves generally perpendicular to the axis of the through bore and to force block material laterally into the through bore to form a series of protrusions extending into said bore along the length thereof. In the preferred embodiment, the spaced grooves on each face are positioned with respect to the grooves on the opposite face to provide a staggered arrangement of said protrusions along the length of the bore.

BRIEF DESCRIPTION OF THE DRAWINGS

FIG. 1 is a front elevation of one embodiment of a heat exchanger using the modular construction of the present invention.

FIG. 2 is an enlarged view of a portion of FIG. 1.

FIG. 3 is a sectional view taken on line 3—3 of FIG. 2.

FIG. 4 is a sectional view taken on line 4—4 of FIG. 1.

FIG. 5 is an end elevation of an extruded block from which a heat exchanger module is made.

FIGS. 6 and 7 are generally schematic showings of various steps in the method of manufacturing a modular heat exchanger in accordance with the present invention.

FIG. 8 is a front elevation of another embodiment of the heat exchanger of the present invention adapted to handle three separate fluid flows.

FIG. 9 is a side elevation of a portion of the heat exchanger shown in FIG. 8.

FIG. 12 is a front elevation of a heat exchanger similar to FIG. 1 showing an alternate embodiment of the construction.

FIG. 13 is a sectional side elevation of one end of the heat exchanger taken on line 13—13 of FIG. 12.

FIG. 14 is an end elevation of the heat exchanger shown in FIG. 12.

DETAILED DESCRIPTION OF THE PREFERRED EMBODIMENTS

Figure 10:
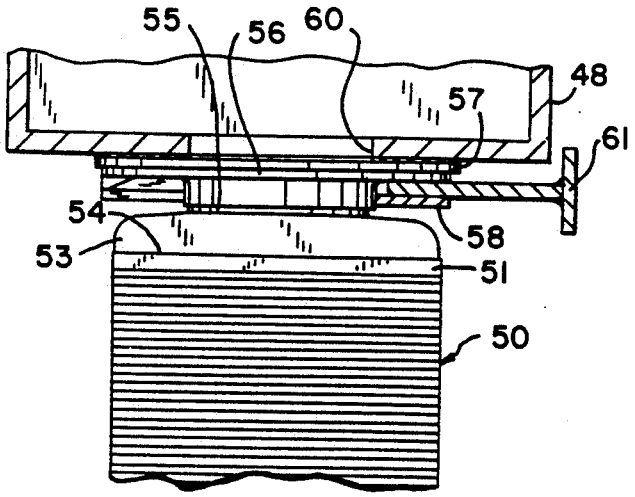
FIG. 10 is a side elevation, partly in section, showing a demountable heat exchanger core element utilizing another embodiment of the modular construction of the present invention.

Referring initially to FIGS. 1–4, a heat exchanger 10 includes a series of identical core modules 11 which, in the heat exchanger shown, comprise four in number. Each module 11 is preferably made from an elongate extruded aluminum block 12 which is generally rectangular in cross section and is formed in the extrusion process with a series of three parallel through bores 13 having flattened or oval cross sections. A series of parallel fins 14 is formed on each of the opposite wider faces 15 of the block 12 to overly the series of through bores 13. The fins 14 are formed to extend generally perpendicular to the axes of the through bores, and the outer edges 16 of the fins lie coplanar with the face 15 in which they are formed.

The heat exchanger 10 is formed by stacking the four modules 11 together in face-to-face contact with the edges 16 of the fins 14 on adjacent modules 11 directly abutting one another. As is best shown in FIG. 2, the modules 11 in the assembled heat exchanger define interior air flow passages 17 between adjacent modules which are two times the height of the fins in length and as wide as the slot between adjacent fins. The heat exchanger is enclosed and held between a pair of outer mounting plates 20 which abut the outer edges 16 of the fins on the outside faces of the outer modules to define a series of outer air flow passages 18 half the length of the interior air flow passages 17.

The opposite ends of each module on both faces 15 include flat face portions 21 in which no fins are provided. In the assembled heat exchanger 10 the face portions 21 on adjacent modules 11 lie in direct face-to-face contact.

A cross bore 22 extends through the modules 11 with its axis centered in the face portions 21 and extending perpendicular thereto. As may best be seen in FIG. 3, the cross bore 22 is sized and positioned to intersect all three through bores 13 in each module 11. Thus in the four-module construction shown in FIGS. 1–4, the cross bore 22 intersects a total of 12 through bores 13. The cross bores 22 on opposite ends of the heat exchanger 10 provide for accumulation of the fluid flow at the inlet and outlet ends 23 and 24 of the heat exchanger. The interfaces between adjacent face portions 21 where the cross bore 22 passes through must be sealed to prevent fluid leakage. The cross bore portion 25 of one face portion 21 at each interface is provided with a shallow counterbore 26 sized to receive a conventional O-ring 27 for sealing the abutting face portions around the periphery of the cross bore passage therethrough. The outer mounting plates 20 are also used as clamping plates to hold the modules together in the heat exchanger and to maintain adequate leak-tight compression of the O-ring seals. A set of four long connecting bolts 28 extends between the mounting plates 20 and through a series of aligned holes in the four corners of the face portions 21 parallel to the axes of the cross bores 22. Nuts 30 are threaded onto the ends of the bolts 28 and tightened to uniformly compress the seals and hold the modules in face-to-face contact. The inlet and outlet 23 and 24, respectively, are provided with appropriate gasket seals around the cross bores 22 at the interface between the mounting plates 20 and the face portions 21.

The cross bore 22 may be provided as blind cross bore by providing one end face of each outer module 11 with a blind cross bore portion 31. However, since the cross bore portions 25 are preferably provided on an individual module basis and to maintain exact identity between the modules, it is preferred to drill all cross bore portions 25 as through bores and to appropriately plug the blind cross bore portions 31, as with weld material or appropriate elastomer seals between the mounting plate 20 and the adjacent face portion 21. Similarly, the ends of all of the through bores 13 on the ends of heat exchanger 10 must be plugged, as best shown in FIG. 3. The plugs 32 may comprise permanent welds, elastomer plugs, or the like.

Referring to FIGS. 8 and 9, a modified modular heat exchanger 33 is adapted to handle three separate fluid flows utilizing a modified arrangement of modules 11 essentially identical to those described with respect to the preceding embodiment. The heat exchanger 33 is divided into three separate sections, each adapted to handle a different type of fluid which may be utilized in an automotive system, such as a large truck or a piece of off-the-road equipment. Thus, the unit 33 includes an upper heat exchanger 34 which may, for example, comprise a conventional radiator for the engine coolant; a center heat exchanger 35 which may function as a lubricating oil cooler; and, a lower heat exchanger 36 which may comprise an air charged cooler for the engine turbocharger. As shown, the upper, center and lower heat exchangers 34, 35 and 36 include, respectively, four, two and three modules 11. However, this is merely an example of a multifluid heat exchanger and the number of modules 11 in each of the component heat exchangers may be varied as desired.

The construction and operation of each of the heat exchangers 34–36 is essentially the same as that shown in FIG. 1 and previously described, except for the following differences. To separate the three fluid flows, adjacent component heat exchangers 34 and 35, or 35 and 36, are separated by an intermediate separator plate 37 which may be essentially the same as the outer mounting plate 20.

Preferably, each of the modules 11 is identical and includes identical through cross bore portions 25 in each end, one face portion 21 of each of which is provided with a counterbore 26 for an O-ring 27. To maintain identity in the modules 11 and yet accommodate the necessary seals between the mounting plate 20 or the separator plate 37 and the face portion 21 of the adjacent module 11, one end of each mounting plate 20 is provided with a counterbore 38 for the inlet (or outlet) opening 40 to receive an O-ring 27 for sealing the interface with the face portion 21 of the module not provided with a counterbore 26. Similarly, each end of the intermediate separator plate 37 is provided on one side only with a blind counterbore 41 to seal the interface with the module face portion 21 not having a counter bore 26 on that end of its cross bore portion 25. The separator plates 37, of course, are not through bored.

Also, the edges of the mounting plates 20 and separator plates 37 are preferably lengthened to extend beyond the outer peripheral edges of the modules 11 so that the connecting bolts 28 lie completely outside the heat exchanger 33, thereby eliminating the need for connecting bolt holes in the modules 11. The modules 11 are otherwise clamped together and the various O-ring seals appropriately compressed by tightening the bolts as previously indicated.

The accommodation of three independent heat exchangers inhibits somewhat the areas available for connecting the fluid inlets and outlets. As shown in FIG. 8, the inlet and outlet 42 for the upper heat exchanger 34 both communicate directly with the upper outside module 11 with appropriate connections through the mounting plate 20. Similarly, the inlet and outlet 44 for the lower heat exchanger 36 connect directly to the cross bores 22 in the lower outside module 11, also via appropriate connections in the lower mounting plate 20. The center heat exchanger 35, however, requires inlet and outlet connections 43 to be made via appropriate connecting bores 45 through the front faces 46 of the modules 11. The inlets and outlets 42, 44 for the upper heat exchanger 34 and lower heat exchanger 36, respectively, could also be made via connecting bores in the module front faces 46 in the same manner as center heat exchanger 35.

In FIG. 10, there is shown a modular heat exchanger 47 constructed from a number of modules 50 which are permanently attached to one another so that the heat exchanger is not disassemblable. However, the heat exchanger 47 itself is provided with a mounting assembly of the type shown in my prior U.S. Pat. No. 5,042,572 whereby the unit may be demountably attached at its upper and lower ends to an upper tank 48 and a similar lower tank (not shown).

Each of the modules 50 is similar in construction to the modules 11 previously described, except that the opposite end portions defining the flat face portions 51 are somewhat shorter than the corresponding face portions 21 of the modules 11. The modules 50 are assembled in face-to-face position and are permanently secured in that position with a series of welds 52 along the end lines defining the common outer edges of adjoining face portions 51. A flexible connecting plate 53 is attached by a continuous welded or brazed joint 54 (depending on the material from which the plate is made) to the peripheral edge of the welded block of modules 50. The connecting plate 53 includes an open central neck 55 to which is attached a flared end flange 56. The end flange is provided with a peripheral gasket 57, and the flange and gasket are adapted to be slid horizontally into a flanged U-shaped mounting bracket 58 which is secured to the underside of the tank 48 around the fluid inlet 60. A bifurcated wedge 61 is then driven into the slot defined by the mounting bracket 58, between the bracket and the underside of the end flange 56 to compress the gasket 57 into sealing engagement with the face of the tank and secure the heat exchanger to the tank. The opposite lower end of the heat exchanger is provided with a similar connecting assembly to simultaneously attach the lower end of the heat exchanger to the similar lower tank. The entire heat exchanger is demountable for easy removal and replacement by removing the upper and lower wedges 61 and sliding the end flanges from the mounting brackets 58, all in a manner described in greater detail in my above identified patent.

An advantage of using an all aluminum construction, including the modules 50 and the connecting plates 53 on both ends, is that the welded joints may be made without the use of solder or brazing materials containing lead or other potentially hazardous metals. A large heat exchanger, such as an automotive radiator, may be assembled from a number of heat exchangers 47 demountably attached as described above such that each heat exchanger 47 itself comprises an intermediate module in a modular heat exchanger.

Referring now to FIGS. 6–8, a description of the presently preferred manner of making heat exchanger modules 11 from extruded aluminum blocks 12 will be set forth. Aluminum extrusions including the pattern of three parallel through bores 13 are available in any convenient lengths from which blocks 12 may be cut to any desired final module length. One size of suitable aluminum extrusion has a rectangular cross section approximately $\frac{7}{8}$ inch (2.2 cm) wide and $3\frac{3}{4}$ inches (9.5 cm) long. Each of the through bores 13 has an identical oval cross section which is approximately $\frac{1}{4}$ inch (0.6 cm) wide and 1.1 inch (2.8 cm) long.

The fins 14 are cut into each of the opposite faces 15 of the block 12 using an arrangement of ganged cutting blades having an overall length equal to the desired length of the pattern of fins. In the presently preferred embodiment, each of the blades has a thickness sufficient to provide a slot 62 between the fins 1/16 inch (1.6 mm) in width and the blades are spaced to provide fin thicknesses between the slots 62 of 1/32 inch (0.8 mm). The ganged cutting blades are mounted below the horizontal surface of a cutting table and are positioned to extend the blade cutting edges above the surface of the table by an amount to provide a slot depth and fin height of $\frac{1}{4}$ inch (6.4 mm). Cutting depth must be accurately controlled since the final internal wall thickness between the bottoms of the slots 62 and the long walls of the oval through bores 13 is only 0.015–0.020 inch (about 0.5 mm). Preferably, the aluminum block 12 is pushed through the ganged cutting blades with a suitable ram while the block is held in contact with the cutting table surface with spring-biased rollers in contact with the upper face 15 of the block. After the pattern of fins 14 is cut into one face, the block is turned over and an identical fin pattern is cut into the opposite face.

Preferably, before the fins are cut into the block, each of the faces 15 is provided with a series of grooved indentations 63 at spaced intervals along the block and extending across the block in the same direction as the slots and fins to be subsequently formed therein. The indentations 63 may be formed using any suitable cold forming technique causing permanent surface deformation, such as the blunt-edged knife 69. Formation of the indentations 63 results in similar protrusions or ribs 64 being formed on the interiors of the through bores 13. Further, the grooved indentations 63 are staggered from one face 15 of the block to the other, such that the ribs 64 form a staggered pattern along the lengths of the bores as shown. The ribs provide partial barriers or interruptions to the fluid flowing through the bores, resulting in a wavey and more turbulent flow which, in turn, results in improved heat exchange between the fluid and the walls of the module. After the grooved indentations 63 are formed in both faces 15 of the block, the fins 14 may be cut in the same manner previously described.

Another embodiment of a modular heat exchanger of the present invention is shown in FIGS. 12–14. The heat exchanger 65 of this embodiment utilizes two different lengths of modules, including axially shortened interior modules 66 and longer exterior modules 67 on the outside faces of the heat exchanger. The heat exchanger 65 is fully disassemblable and is assembled initially and held together between a pair of outer mounting plates 20 with connecting bolts 28 in the same manner described with respect to the previous embodiments. Extended mounting plates 20 are preferably utilized so that the connecting bolts 28 may lie completely on the outside of the heat exchanger, as previously described.

All of the modules 66 and 67 are stacked in the manner previously described in face-to-face contact with the outer edges 16 of the fins 14 on adjacent modules abutting one another. The interior air flow passages 17 and outer air flow passages 18 are thus provided in a manner identical to the embodiment of FIG. 1.

Each of the short interior modules 66 has, on each of its opposite ends, a short face portion 68 in which no fins 14 are cut. The opposite ends of each longer exterior module 67 are provided with longer extended face portions 70. A generally U-shaped notch 71 is thus provided on each end of the heat exchanger 65, defined by the opposed inside extended face portions 70 on the two exterior modules 67 and the end faces 72 of the interior modules 66. A generally cube-shaped end block 73 is positioned in the notch 71 at each end of the heat exchanger. The end block includes opposite block faces 74 which abut and lie face-to-face with the extended face portions 70 of the exterior modules 67. The block includes a large outer cross bore 75 which extends through the block and is directly aligned with cross bore portions 76 in the ends of the exterior modules 67. The combination of the outer cross bore 75 in the end block 73 and the aligned cross bore portions 76 in the exterior modules 67 defines an end tank for the accumulation of fluid passing through the various modules 66 and 67 from which the heat exchanger is constructed, as will be described hereinafter.

The front face 77 of each end block 73 includes a short bore portion 78 which intersects the cross bore 75. An outer connecting sleeve 80 is connected to the short bore section 78 to provide means for attaching a conventional radiator hose or the like (not shown). This construction allows the heat exchanger 65 to be adapted for an application in which the connections thereto can only be made through the front (or rear) face of the heat exchanger unit.

In order to assure uniform flow of the fluid through the heat exchanger 65 and to avoid preferential or short-circuited flow through the interior modules 66, the modules are provided at both ends with an intermediate header 81 comprising aligned interior header bores 82 in each of the interior modules 66 and exterior header bores 83 in each exterior module 67. The interior and exterior header bores 82 and 83 may be suitably counterbored for the receipt of O-ring seals in the same manner previously described for the other embodiments of the invention.

Referring particularly to FIGS. 13 and 14, the intermediate headers 81 preferably utilize three parallel intermediate header bores 84, each intersecting one of the commonly positioned through bores 13 in the modules 66 and 67. In other words, in the embodiment shown, each intermediate header bore 84 intersects five commonly positioned parallel through bores 13 extending through each of the three interior modules 66 and the two exterior modules 67.

The ends of the through bores 13 in the interior modules 66, between the header bores 84 and the end faces 72 of the modules, are suitably plugged, as shown at 85 in FIG. 13 The through bores 13 of each of the exterior modules 67, on the other hand, are provided with enlarged through bore extensions 86 which provide fluid connections between the intermediate header bores 84 and the cross bore portions 76. In this manner, the fluid flow along the through bores of the interior modules 66 is forced to flow laterally toward the outside through the intermediate header 81, thereby allowing equalized flows through the through bores in the exterior modules 67 as well.

To assemble the heat exchanger of FIGS. 12–14, the modules 66 and 67 are stacked as previously indicated, with the end block 73 inserted into the notch 71, and each interface between adjacent parts containing fluid communications provided with a suitable O-ring seal. Thus, each interior and exterior header bore 82 and 83, where it joins a like header bore or meets a mounting plate 20, is provided with an O-ring 87 seated in a suitable counterbore 88. Similarly, the interfaces between the larger outer cross bore and cross bore portions 75 and 76 and the juncture of the latter with each of the mounting plates 20 are sealed with larger O-rings 90 seated in suitable counterbores 91. It will be seen that all of the O-ring seals 87 and 90 are positioned to be appropriately compressed upon tightening of the connecting bolts 28 to secure the heat exchanger assembly together.

Figure 11:
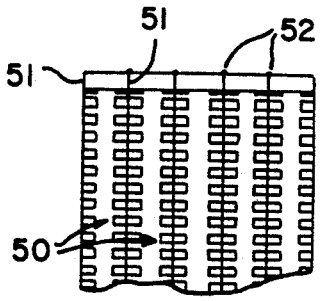
FIG. 11 is a front elevation view of a portion of the heat exchanger of FIG. 10 showing connection of the modules.
Figure 15:
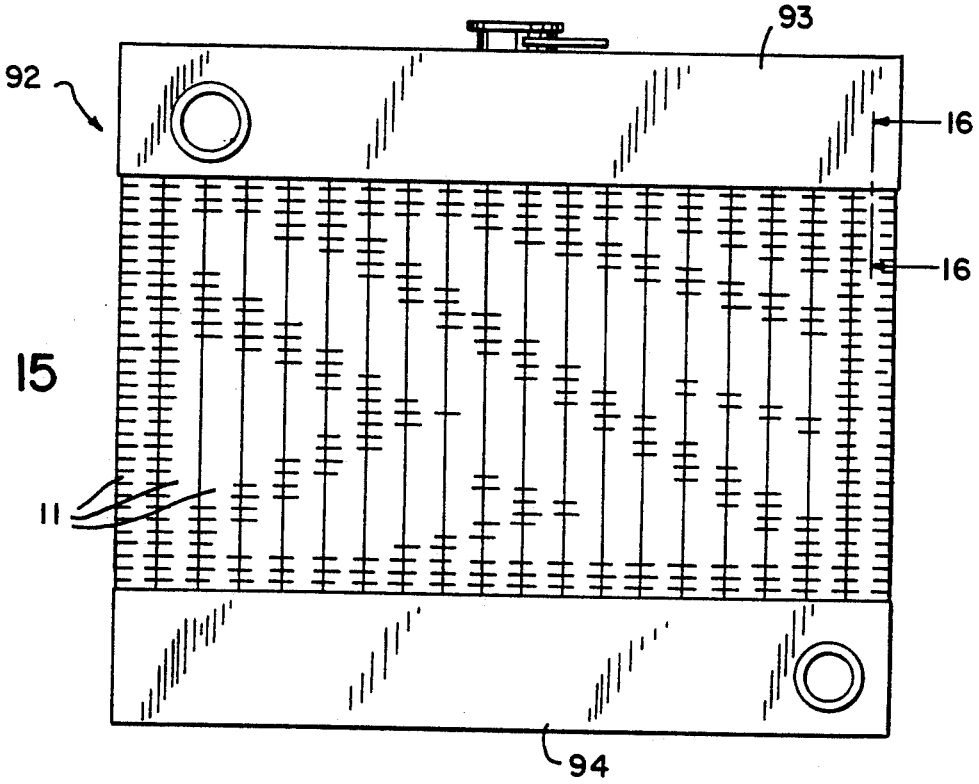
FIG. 15 is a front elevation of a modular heat exchanger of the present invention configured to be used in an automotive radiator application.
Figure 16:
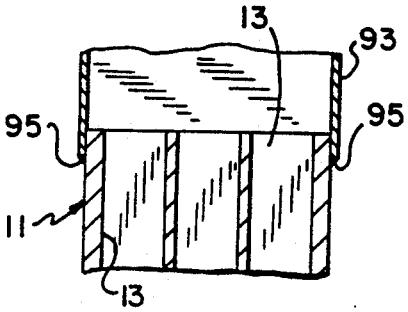
FIG. 16 is a sectional view taken on line 16—16 of FIG. 15.

Referring now to FIGS. 15 and 16, the modular assembly of the present invention may also be utilized to construct an automotive radiator 92 of a more conventional design. In this assembly, a series of individual modules 11 is permanently interconnected, as with welds 52 on opposite ends as previously described with respect to FIG. 11. An upper tank 93 and a lower tank 94 are welded to the top and bottom, respectively, of the welded subassembly of modules 11 with continuous welds 95 around the edges of the tanks and the modules, as shown. The throughbores 13 in the modules 11 provide direct fluid flow to and from the tanks 93 and 94.

Various modes of carrying out the present invention are contemplated as being within the scope of the following claims particularly pointing out and distinctly claiming the subject matter which is regarded as the invention.

I claim:

1. A modular heat exchanger for a fluid flow comprising:

a plurality of modules formed from elongate extruded aluminum blocks, each block having a generally rectangular cross section between planar opposite outer faces and a longitudinally extending throughbore having an elongate cross section defined by generally flat bore surfaces lying parallel to said planar opposite faces;

each module having a plurality of generally rectangular equally spaced parallel slots formed in said outer faces, said slots extending fully across said outer faces in a lateral direction with respect to the longitudinal axis of the throughbore and defining therebetween a series of parallel fine, said fins lying in planes generally perpendicular to the longitudinal axis of the throughbore, the outer edge surfaces of the fins on each face lying coplanar with the face of the block in which the fins are formed;

attachment means for securing the modules together in face-to-face contact with the outer edge surfaces of the fins on adjacent modules abutting one another to provide a series of uniformly sized air flow passages between and completely through each adjacent pair of modules; and, fluid accumulation means on opposite ends of the attached modules for interconnecting the open ends of the through-bores on each of said opposite ends.

2. The heat exchanger as set forth in claim 1 wherein said attachment means is demountable.

3. The heat exchanger as set forth in claim 2 wherein said attachment means comprises:

a plurality of tie rods for each end of the heat exchanger extending across the modules in a direction perpendicular to said opposite faces; and, means for tensioning the tie rods to clamp the modules together.

4. The heat exchanger as set forth in claim 1 wherein said attachment means is permanent.

5. The heat exchanger as set forth in claim 4 wherein said attachment means comprises welded connections attaching each adjacent pair of modules.

6. The heat exchanger as set forth in claim 1 comprising:

face portions at both ends of each of said opposite faces, which face portions define the ends of each series of fins; and, wherein said fluid accumulation means comprises a cross bore perpendicular to and passing through abutting face portions and intersecting said through-bores at each end, and means for sealing said abutting face portions around the periphery of each cross bore passage therethrough.

7. The heat exchanger as set forth in claim 6 wherein said sealing means comprises:

a counterbore for said cross bore in one of each pair of abutting face portions; and, an annular seal for each counterbore.

8. The heat exchanger as set forth in claim 7 including means for closing both ends of said throughbores.

9. The heat exchanger as set forth in claim 6 wherein said attachment means comprises:

a face plate for the outside face portions of the outside modules; and, tie rod means extending through the face plates on both ends of the modules for clamping said modules together and compressing said sealing means.

10. A modular heat exchanger for a plurality of separate fluid flows comprising:

a plurality of modules formed from elongate blocks of aluminum, each block having a generally rectangular cross section between planar opposite outer faces and a plurality of parallel longitudinally extending through bores;

each module having a series of parallel fins on said outer faces of the block overlying the plurality of through bores, said fins disposed between rectangular slots formed in and extending fully across said outer faces in a lateral direction generally perpendicular to the axes of the through bores, the outer edge surfaces of the fins on each face lying coplanar with the face in which said fins are formed;

means for securing the modules together to form an independent heat exchanger for each of the separate fluid flows, each independent heat exchanger including at least two modules, the modules in each heat exchanger arranged in face-to-face contact with the edge surfaces of the fins on adjacent modules in each exchanger abutting one another to provide a series of uniformly sized air flow passages between and completely through each adjacent pair of modules, and the heat exchangers arranged in spaced face-to-face position with the edges of the fins on adjacent heat exchangers abutting the opposite sides of a common separator plate; and, fluid accumulation means on opposite ends of the modules in each heat exchanger for interconnecting the ends of the through bores on each of said opposite ends.

11. A method for making a modular heat exchanger for a fluid flow comprising the steps of:

(1) extruding a plurality of elongate blocks of a heat transfer material, each block having a generally rectangular cross section defined by parallel opposite faces and a longitudinally extending through-bore;

(2) cutting a series of parallel spaced slots in the faces of the block to form fins on opposite faces of the block, said fins lying in planes generally perpendicular to the longitudinal axis of the through-bore, the outer edge surfaces of the fins on each face lying coplanar with the face in which the fins are formed;

(3) securing the modules together in face-to-face contact with the outer edge surfaces of the fins on adjacent modules abutting one another to form a series of uniformly sized air flow passages between each pair of modules; and, (4) interconnecting the ends of the through-bores on both ends of the attached modules to accumulate the fluid flow at each end of the heat exchanger.

12. The method as set forth in claim 11 wherein said blocks are formed of aluminum and including the step of deforming the opposite faces of the blocks to form a series of spaced parallel grooves generally perpendicular to the axis of the through bore and to force block material laterally into the through bore to form a series of protrusions extending into said bore along the length thereof.

13. The method as set forth in claim 12 wherein said spaced grooves on each face are positioned with respect to the grooves on the opposite face to provide a staggered arrangement of said protrusions along said bore.

* * * * *